US010954647B2

(12) United States Patent
Takeuchi

(10) Patent No.: US 10,954,647 B2
(45) Date of Patent: Mar. 23, 2021

(54) FOUNDATION STRUCTURE FOR BUILDING, AND CONSTRUCTION METHOD THEREFOR

(71) Applicant: TAKEUCHI CONSTRUCTION CO., LTD., Hiroshima (JP)

(72) Inventor: Kinji Takeuchi, Hiroshima (JP)

(73) Assignee: TAKEUCHI CONSTRUCTION CO., LTD., Hiroshima (JP)

( * ) Notice: Subject to any disclaimer, the term of this patent is extended or adjusted under 35 U.S.C. 154(b) by 0 days.

(21) Appl. No.: 16/627,678

(22) PCT Filed: Apr. 17, 2018

(86) PCT No.: PCT/JP2018/015895

§ 371 (c)(1),
(2) Date: Dec. 30, 2019

(87) PCT Pub. No.: WO2019/008866

PCT Pub. Date: Jan. 10, 2019

(65) Prior Publication Data

US 2020/0141082 A1 May 7, 2020

(30) Foreign Application Priority Data

Jul. 4, 2017 (JP) ..... JP2017-130847
Feb. 28, 2018 (JP) ..... JP2018-034971

(51) Int. Cl.
*E02D 27/08* (2006.01)
*E02D 3/12* (2006.01)
(Continued)

(52) U.S. Cl.
CPC ..... *E02D 27/08* (2013.01); *E02D 3/12* (2013.01); *E02D 3/00* (2013.01); *E02D 27/01* (2013.01); *E02D 27/26* (2013.01); *E02D 27/28* (2013.01)

(58) Field of Classification Search
CPC ..... E02D 27/01; E02D 27/08; E02D 27/26; E02D 27/28; E02D 3/00; E02D 3/12
(Continued)

(56) References Cited

U.S. PATENT DOCUMENTS 783,901 A * 2/1905 Sheldon ..... E04G 13/02 249/51
1,006,309 A * 10/1911 Spickerman ..... E01B 9/28 238/265
(Continued)

FOREIGN PATENT DOCUMENTS

DE 4005032 A1 * 8/1991 ..... E02D 27/48
EP 0115553 B1 * 5/1987 ..... E02B 3/18
(Continued)

OTHER PUBLICATIONS

International Search Report dated May 22, 2018 from corresponding PCT Application No. PCT/JP2018/015895.

*Primary Examiner* — Patrick J Maestri
*Assistant Examiner* — Joseph J. Sadlon
(74) *Attorney, Agent, or Firm* — Innovation Capital Law Group, LLP; Vic Lin

(57) ABSTRACT

A building foundation structure includes a ground improved body obtained by improving a surface layer ground, and foundation concrete placed on the ground improved body. A bottom surface of a foundation concrete located below a building pillar has a four-or-more-sided polygonal shape smaller than the plan shape of the foundation concrete, and a part of the lower surface of the foundation concrete other than the bottom surface is a slope surface connecting the bottom surface and the plan shape. Since the stress from the foundation is transferred to the lower ground in its broader range, the stress transferred to the lower ground can be reduced. In addition, since the placing amount of the foun-
(Continued)

dation concrete is reduced, the construction cost can be reduced.

2 Claims, 10 Drawing Sheets

(51) Int. Cl.
*E02D 3/00* (2006.01)
*E02D 27/01* (2006.01)
*E02D 27/26* (2006.01)
*E02D 27/28* (2006.01)

(58) Field of Classification Search
USPC ..... 52/741.11; 405/229, 302.4
See application file for complete search history.

(56) References Cited

U.S. PATENT DOCUMENTS 1,690,259 A * 11/1928 Strauss ..... E01C 5/085 404/43
1,805,311 A * 5/1931 Hill ..... E04H 12/223 52/292
2,446,949 A * 8/1948 Neutra ..... E04H 9/021 52/292
2,682,750 A * 7/1954 Lorenz ..... E02D 3/08 405/263
3,099,911 A * 8/1963 Turzillo ..... E02D 3/12 405/266
RE25,614 E * 7/1964 Turzillo ..... E02D 3/12 405/266
3,269,126 A * 8/1966 Freeman, Jr. ..... E02D 35/00 405/230
3,921,354 A * 11/1975 Connelly ..... E04B 1/3412 52/236.1
4,000,622 A * 1/1977 Chiaves ..... E02D 29/0266 405/286
4,037,384 A * 7/1977 Molyneux ..... E02D 27/42 52/698
4,043,909 A * 8/1977 Endo ..... B01F 7/00733 210/738
4,079,930 A * 3/1978 Schiron ..... A63B 5/10 482/30
4,134,707 A * 1/1979 Ewers ..... F03D 3/02 415/4.2
4,241,543 A * 12/1980 Foscarini ..... B28B 21/566 182/90
4,275,538 A * 6/1981 Bounds ..... E02D 27/32 126/617
4,591,466 A * 5/1986 Murray ..... E02D 3/12 264/35
4,714,226 A * 12/1987 Tracy ..... E04G 3/34 182/142
4,767,241 A * 8/1988 Wells ..... E02D 27/02 405/231
4,832,533 A * 5/1989 Ringesten ..... E02D 3/08 405/233
4,832,535 A * 5/1989 Crambes ..... E02D 3/08 405/266
4,843,785 A * 7/1989 Sero ..... E02D 5/72 52/160
4,911,585 A * 3/1990 Vidal ..... E02D 29/0283 405/284
5,085,276 A * 2/1992 Rivas ..... E21B 43/26 166/303
5,689,927 A * 11/1997 Knight, Sr. ..... E01F 8/0023 181/210
6,032,421 A * 3/2000 Yamada ..... E02D 27/12 220/4.26
6,702,522 B2 * 3/2004 Silber ..... E02D 27/42 405/229
6,910,832 B2 * 6/2005 Gagliano ..... E02D 27/14 249/34
7,497,053 B2 * 3/2009 Nicolet ..... E02D 5/74 248/545
7,556,453 B2 * 7/2009 Collina ..... E02D 5/28 405/229
7,661,907 B2 * 2/2010 Armstrong ..... E02D 3/026 405/128.6
7,841,143 B2 * 11/2010 Jensen ..... E04H 12/085 52/296
8,291,668 B2 * 10/2012 Iske ..... E21D 11/381 52/514.5
8,549,799 B2 * 10/2013 Tate ..... A45F 3/44 52/157
8,596,924 B2 * 12/2013 Shimada ..... C09K 17/06 405/233
8,677,700 B2 * 3/2014 Fairbairn ..... E02D 27/42 52/169.9
8,966,837 B2 * 3/2015 Knudsen ..... E02D 5/26 52/165
9,096,985 B1 * 8/2015 Phuly ..... E02D 27/42
9,133,637 B1 * 9/2015 O'Brien ..... E02D 5/80
9,228,313 B2 * 1/2016 Magi ..... E02D 17/207
9,267,258 B2 * 2/2016 Knapp ..... E02D 27/44
9,340,991 B2 * 5/2016 Yandell ..... E04H 12/2238
9,347,197 B2 * 5/2016 Phuly ..... F03D 13/22
9,428,926 B2 * 8/2016 Kramer ..... E04B 1/34326
9,546,465 B2 * 1/2017 Song ..... E02D 3/08
9,567,723 B2 * 2/2017 White ..... E02D 23/00
9,611,615 B2 * 4/2017 Davis ..... E02D 27/01
9,777,456 B1 * 10/2017 Spiro ..... E04H 12/2292
10,344,440 B2 * 7/2019 Surjaatmadja ..... E02D 19/16
10,358,838 B2 * 7/2019 Dominguez ..... E04H 12/2269
10,407,859 B2 * 9/2019 Elfass ..... E02D 5/38
10,633,818 B2 * 4/2020 Spiro ..... E04H 12/2215
10,655,353 B2 * 5/2020 Carless ..... E02D 5/54
10,822,765 B2 * 11/2020 Serna Garcia-Conde ..... E02D 27/425
2007/0181767 A1 * 8/2007 Wobben ..... E02D 27/42 248/346.01
2009/0013625 A1 * 1/2009 Tourneur ..... E02D 27/08 52/223.13
2013/0000236 A1 * 1/2013 Gallardo Hernandez ..... F03D 13/22 52/297
2015/0121784 A1 * 5/2015 Abad Huber ..... E02D 27/08 52/297
2017/0002535 A1 * 1/2017 Surjaatmadja ..... E02D 3/12
2018/0209113 A1 * 7/2018 Birtele ..... E04G 23/0211

FOREIGN PATENT DOCUMENTS

GB 217541 A * 8/1924 ..... E02D 7/24
GB 796959 A * 6/1958 ..... E02D 3/12
JP 60203729 A * 10/1985 ..... E02D 3/12
JP 2003278173 A 10/2003
JP 3608568 B1 1/2005
JP 5494880 B1 5/2014
JP 2014145176 A 8/2014
WO WO-2013058596 A1 * 4/2013 ..... E02D 3/12

* cited by examiner

FOUNDATION STRUCTURE FOR BUILDING, AND CONSTRUCTION METHOD THEREFOR

TECHNICAL FIELD

The present invention relates to: a building foundation structure including a ground improved body obtained by improving a surface layer ground, and foundation concrete placed on the ground improved body; and a construction method therefor.

BACKGROUND ART

There has been known a building foundation structure including a ground improved body obtained by improving a surface layer ground, and foundation concrete placed on the ground improved body (see, for example, Patent Literatures 1 and 2).

Such a building foundation structure has features that: construction cost is reduced with a simple structure; a support force of the entire foundation can be improved while differential settlement can be suppressed; and liquefaction of sediment at the time of an earthquake is effectively inhibited by a ground covering effect, for example.

In such a building foundation structure, generally, the shape of a lower surface of foundation concrete located below a building pillar is a square, and the shape of the foundation concrete is a rectangular parallelepiped (square prism) (see, for example, an engagement projection 7a in FIG. 5 of Patent Literature 1, and FIG. 1 of Patent Literature 2).

CITATION LIST

Patent Literature

[PTL 1] Japanese Patent No. 3608568
[PTL 2] Japanese Patent No. 5494880

SUMMARY OF THE INVENTION

Problems to be Solved by the Invention

The present inventor has conducted thorough studies for further improvement in the building foundation structure having the above features, and has conceived of revising the shape of the lower surface of the foundation concrete located below the building pillar. Then, various studies for the shape have been conducted.

As a result, the shape that achieves both of reduction in stress transferred to a lower ground and reduction in construction cost by reducing the placing amount of the foundation concrete has been figured out, and further, a parameter study has been conducted, thus arriving at completion of the present invention.

An object to be achieved by the present invention is to, in a building foundation structure including a ground improved body obtained by improving a surface layer ground, and foundation concrete placed on the ground improved body, reduce stress transferred to a lower ground, and reduce construction cost by reducing the placing amount of the foundation concrete.

Solution to the Problems

To achieve the above object, a building foundation structure according to the present invention includes a ground improved body obtained by improving a surface layer ground, and foundation concrete placed on the ground improved body. The foundation concrete located below a building pillar has a bottom surface having a four-or-more-sided polygonal shape smaller than a plan shape of the foundation concrete. The foundation concrete has a lower surface including the bottom surface, a part of the lower surface other than the bottom surface being a slope surface connecting the bottom surface and the plan shape. (claim 1).

Here, it is preferable that a slope angle of the slope surface from a horizontal plane is not less than 20° and not greater than 40° (claim 2).

According to the above building foundation structure, the bottom surface of the foundation concrete located below the building pillar is formed in a four-or-more-sided polygonal shape smaller than the plan shape of the foundation concrete, and a part of the lower surface of the foundation concrete other than the bottom surface is formed to be slope surfaces connecting the bottom surface of the foundation concrete and the plan shape of the foundation concrete, whereby the range in which stress is transferred from the foundation to the lower ground is broadened, and thus stress transferred to the lower ground can be reduced.

In addition, since the foundation concrete located below the building pillar has the shape mentioned above, the volume thereof becomes smaller as compared to the shape of conventional foundation concrete. Therefore, the placing amount of foundation concrete can be reduced, and thus construction cost can be reduced.

In particular, when the slope angle of the slope surface from the horizontal surface is set to be not less than 20° and not greater than 40°, the reduction rate of stress transferred to the lower ground and the reduction rate of the placing amount of the foundation concrete are increased.

To achieve the above object, a construction method for a building foundation structure according to the present invention is a construction method for a building foundation structure that includes a ground improved body obtained by improving a surface layer ground, and foundation concrete placed on the ground improved body, The construction method includes: a ground improvement step; a foundation excavation step; and a foundation placing step. The ground improvement step is a step of backfilling soil obtained by digging a surface layer ground down, mixing and stirring the soil while adding and mixing a solidification material, and then performing compaction to form the ground improved body. The foundation excavation step includes a step of excavating an upper part of the ground improved body located below an above-ground part of a building pillar, into a polygonal prism shape with a four-or-more-sided base, to form an upper excavated portion, and a step of excavating a part below the upper excavated portion, so as to form a bottom surface having a four-or-more-sided polygonal shape smaller than a plan shape of the upper excavated portion, and form a slope surface connecting the bottom surface and a lower end of the upper excavated portion, thus forming a lower excavated portion. The foundation placing step is a step of placing leveling concrete into the lower excavated portion, performing foundation reinforcing bar arrangement in the upper excavated portion and the lower excavated portion, and placing the foundation concrete.

Here, it is preferable that a slope angle of the slope surface from a horizontal plane is not less than 20° and not greater than 40°.

According to the above construction method for the building foundation structure, in the foundation excavation step, the ground improved body formed in the ground improvement step is excavated to form the upper excavated portion having a polygonal prism shape with a four-or-more-sided base, and form, below the upper excavated portion, the lower excavated portion that has a bottom surface having a four-or-more-sided polygonal shape smaller than the plan shape of the upper excavated portion, and a slope surface connecting the bottom surface and the lower end of the upper excavated portion. Thus, when the polygonal prism shape is a square prism shape, i.e., the plan shape is a square, and the shape of the bottom surface is a square, for example, the shape of the lower surface of the foundation concrete placed in the foundation placing step becomes a reverse quadrangular frustum.

Therefore, in the building foundation structure constructed by the above construction method, the range in which stress is transferred from the foundation concrete to the lower ground is broadened, and thus stress transferred to the lower ground can be reduced.

In addition, since the foundation concrete located below the building pillar has the above shape, the volume thereof becomes smaller as compared to the shape of conventional foundation concrete. Therefore, the placing amount of foundation concrete can be reduced, and thus construction cost can be reduced.

In particular, at the time of forming the lower excavated portion in the foundation excavation step, the slope angle of the slope surface from the horizontal surface is set to be not less than 20° and not greater than 40°. With this configuration, the reduction rate of stress transferred to the lower ground and the reduction rate of the placing amount of the foundation concrete are increased.

Advantageous Effects of the Invention

As described above, the building foundation structure and the construction method therefor according to the present invention can reduce stress transferred to the lower ground, and reduce construction cost by reducing the placing amount of the foundation concrete.

BRIEF DESCRIPTION OF THE DRAWINGS

FIG. 1 shows a building foundation structure according to embodiment 1 of the present invention, where

FIG. 3 shows a state in which, in a foundation excavation step, an upper excavated portion and a lower excavated portion are formed in a ground improved body formed in a ground improvement step, where

FIG. 4 shows a finite-element-method (FEM) analysis model of ground (hereinafter referred to as "ground FEM analysis model"), where

FIG. 5 shows a shape in the case where a slope angle α is 0° (Comparative example) in FIG. 4, where

FIG. 8 shows foundation concrete in a building foundation structure according to embodiment 2 of the present invention, where

FIG. 9 shows foundation concrete in a building foundation structure according to embodiment 3 of the present invention, where

FIG. 10 shows foundation concrete in a building foundation structure according to embodiment 4 of the present invention, where

DESCRIPTION OF EMBODIMENTS

Hereinafter, embodiments according to the present invention will be described with reference to the drawings.

A building foundation structure 1 according to the present invention includes a ground improved body 2 obtained by improving a surface layer ground G, and foundation concrete 3 placed on the ground improved body 2.

A bottom surface BS1 of the foundation concrete 3 located below a building pillar 4 is formed in a four-or-more-sided polygonal shape smaller than the plan shape of the foundation concrete 3. A part of the lower surface of the foundation concrete 3 other than the bottom surface BS1 is formed to be slope surfaces connecting the bottom surface BS1 and the plan shape of the foundation concrete 3.

Embodiment 1

Figure 1A:
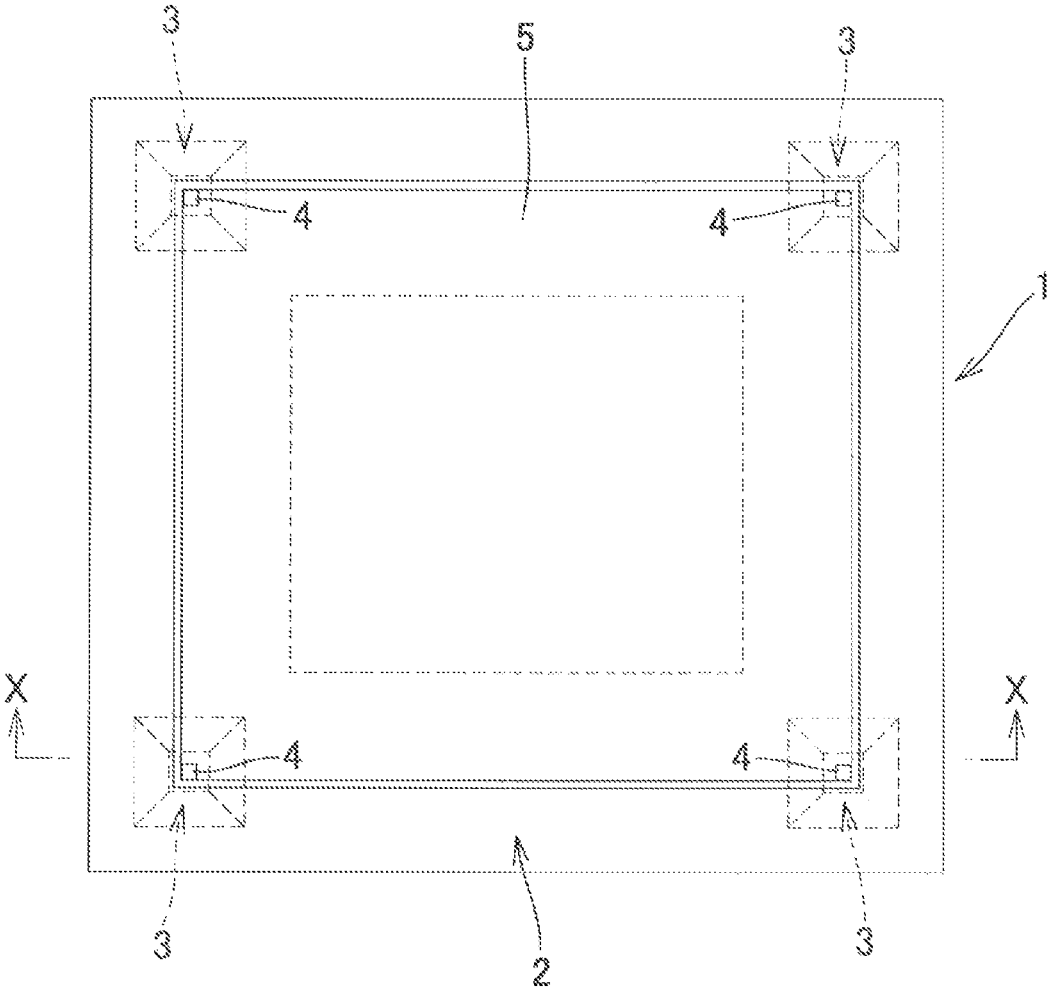
FIG. 1A is a plan view and FIG. 1B is a sectional view taken along arrows X-X in FIG. 1A.
Figure 1B:
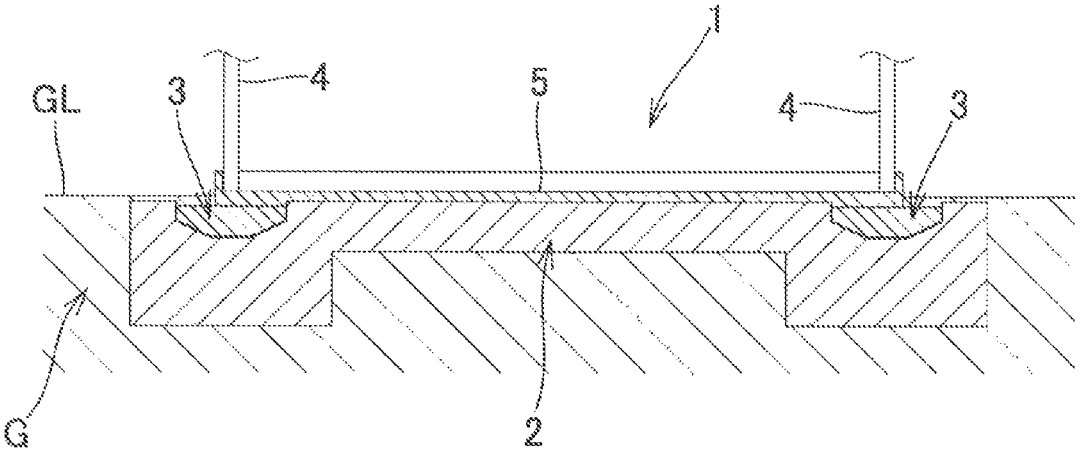
Figure 2:
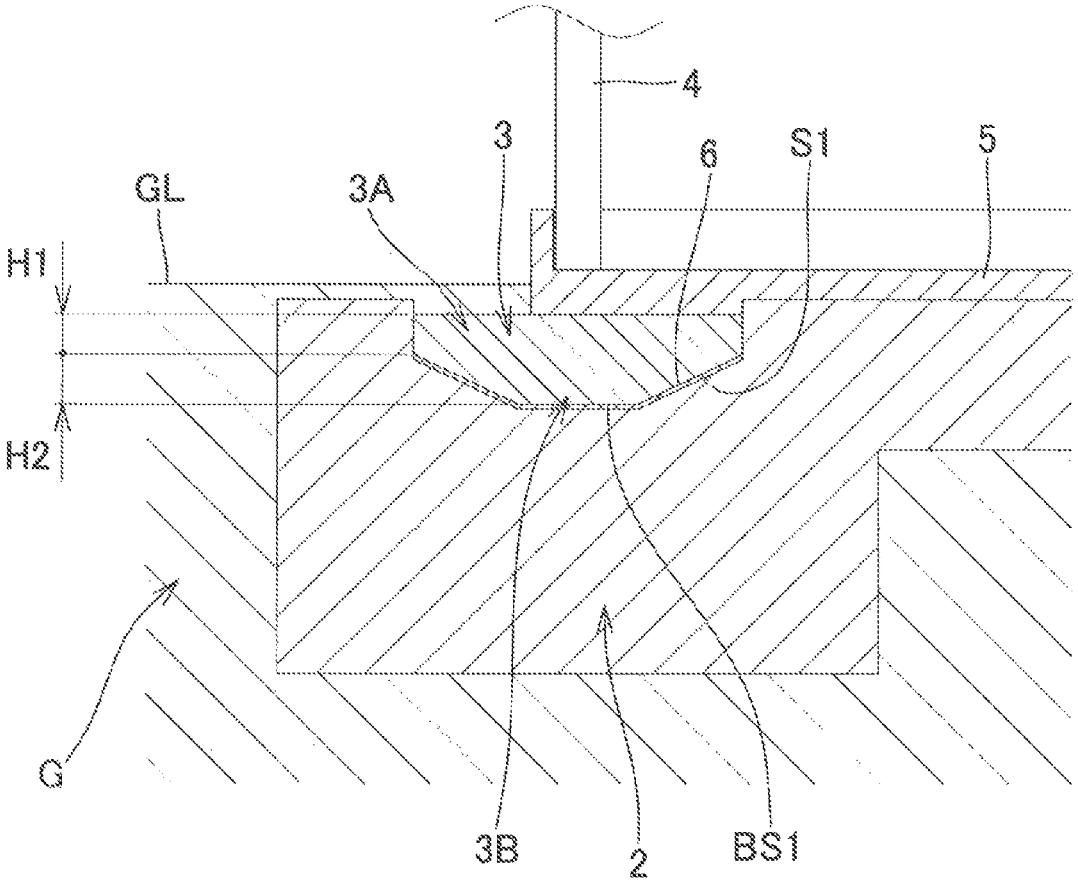
FIG. 2 is an enlarged view of a major part in FIG. 1B.

A plan view in FIG. 1A, FIG. 1B which is a sectional view along arrows X-X in FIG. 1A, and a major part enlarged sectional view in FIG. 2 show a building foundation structure 1 according to embodiment 1 of the present invention.

The building foundation structure 1 includes a ground improved body 2 obtained by improving a surface layer ground G, and foundation concrete 3 placed on the ground improved body 2.

The plan shape of the foundation concrete 3 is a square, and a bottom surface BS1 of the foundation concrete 3 is a square smaller than the plan shape of the foundation concrete 3.

A part of the lower surface of the foundation concrete 3 other than the bottom surface BS1 is formed to be slope surfaces S1 that connect the bottom surface BS1 and the plan shape of the foundation concrete 3 as shown in FIG. 2. In the present embodiment, the shape of the lower surface of the foundation concrete 3 is a reverse quadrangular frustum.

The building foundation structure 1 according to the present embodiment is individual footing. However, continuous footing or mat foundation may be employed.

Next, an example of a construction process for the building foundation 1 will be described.

<Ground Improvement Step>

(Dig-Down Step)

The surface layer ground G below a ground level GL shown in FIG. 1B and FIG. 2 is dug down in a desired shape by, for example, plowing using a backhoe.

(Primary Improvement Step)

Next, a primary improvement step is performed as follows. A backhoe, for example, to which a mixing fork is mounted as an attachment, is used to perform excavation on the ground into a square shape which corresponds to the lower-part shape of the ground improved body 2. Then, mixing and stirring are performed while a solidification material such as a cement-based solidification material is added and mixed, and compaction is performed by a heavy machine and a roller, etc., to form the lower part of the ground improved body 2.

(Secondary Improvement Step)

Next, a secondary improvement step is performed as follows. The soil obtained by digging in the dig-down step is backfilled to the upper side of the lower part of the ground improved body 2 by a backhoe or the like. Then, a backhoe, for example, to which a mixing fork is mounted as an attachment, is used for excavating the surface layer ground G from the ground level GL into the upper-part shape of the ground improved body 2. Then, mixing and stirring are performed while a solidification material is added and mixed, and compaction is performed by a heavy machine and a roller, etc., to form the upper part of the ground improved body 2.

<Foundation Excavation Step>

(Upper excavated portion forming step)

Next, with respect to the ground improved body 2 formed in the ground improvement step, as shown in a plan view in FIG. 3A and a sectional view in FIG. 3B, the upper part of the ground improved body 2 located below the above-ground part of each steel pillar 4 shown in FIG. 1A, FIG. 1B, and FIG. 2 is excavated to a predetermined depth into a rectangular parallelepiped shape in a range of a transverse width B1 and a longitudinal width W1 shown in FIG. 3A, by a backhoe or the like, to form an upper excavated portion 2A.

(Lower Excavated Portion Forming Step)

Next, a part below the upper excavated portion 2A is excavated into a reverse quadrangular frustum so that a bottom surface BS2 has a square shape, and thus a lower excavated portion 2B is formed.

Figure 3A:
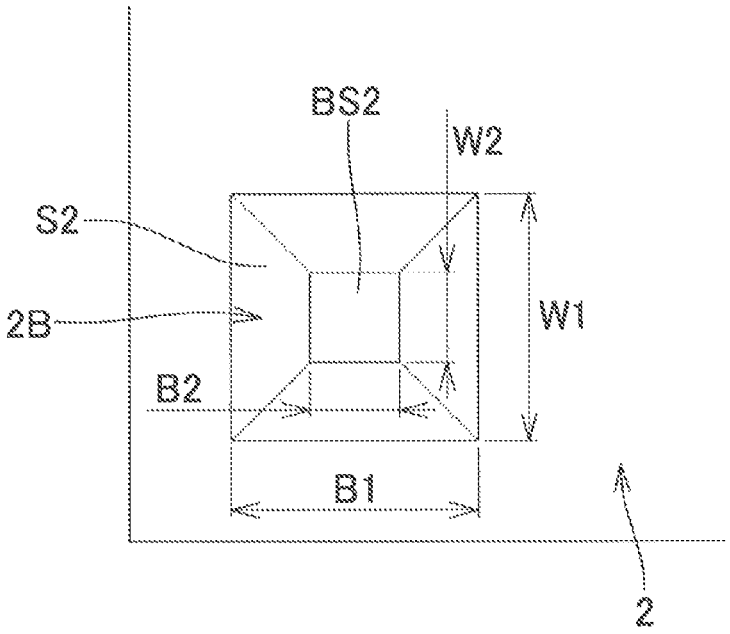
FIG. 3A is a plan view and FIG. 3B is a sectional view.
Figure 3B:
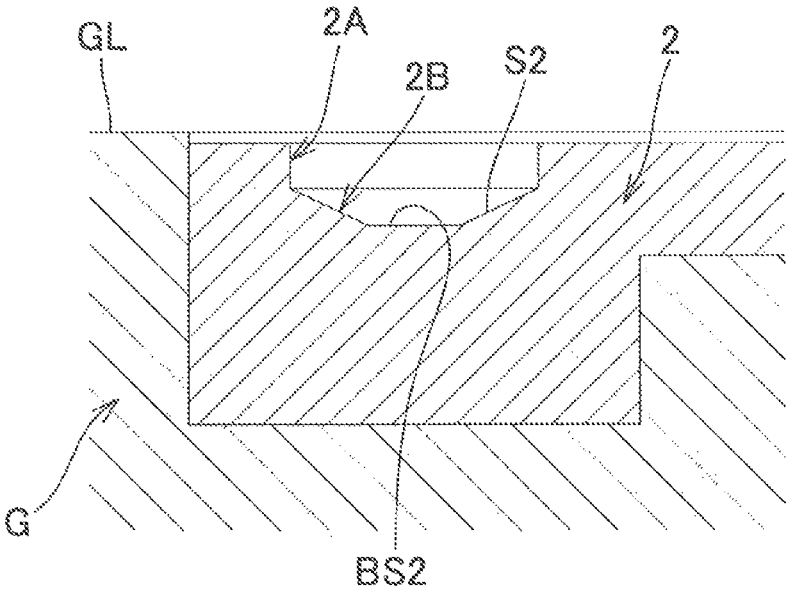

For example, the lower excavated portion 2B is formed by performing excavation to a predetermined depth into a rectangular parallelepiped shape in a range of a transverse width B2 and a longitudinal width W2 shown in FIG. 3A, by a backhoe or the like, and then performing excavation so as to form slope surfaces S2 in a reverse quadrangular frustum shape shown in FIG. 3B.

<Foundation Placing Step>

Then, leveling concrete 6 shown in FIG. 2 is placed into the lower excavated portion 2B.

Next, a pedestal anchor bolt for fixing the steel pillar 4 is fixed to the leveling concrete 6, foundation reinforcing bar arrangement is performed in the upper excavated portion 2A and the lower excavated portion 2B, and foundation concrete 3 is placed.

An upper part 3A (range of height H1 in FIG. 2) of the foundation concrete 3 is formed in a rectangular parallelepiped shape, and a lower part 3B (range of height H2 in FIG. 2) of the foundation concrete 3 is formed in a reverse quadrangular frustum shape.

Next, the steel pillar 4 is installed and floor concrete 5 is placed.

Through the above process, construction of the building foundation (understructure) 1 shown in FIG. 1A and FIG. 1B is completed.

<Confirmation of Effects Through Numerical Analysis>

Next, numerical analysis performed for confirming effects will be described.

(Analysis Method)

Figure 4A:
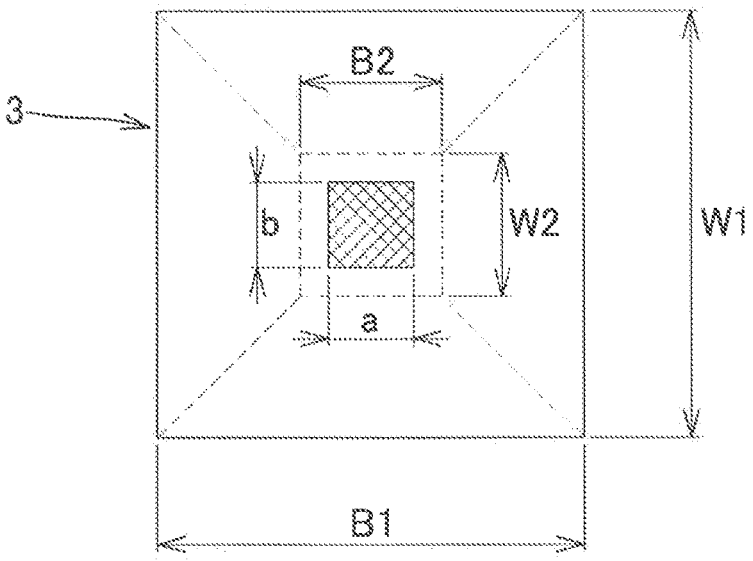
FIG. 4A is a plan view and FIG. 4B is a sectional view.
Figure 4B:
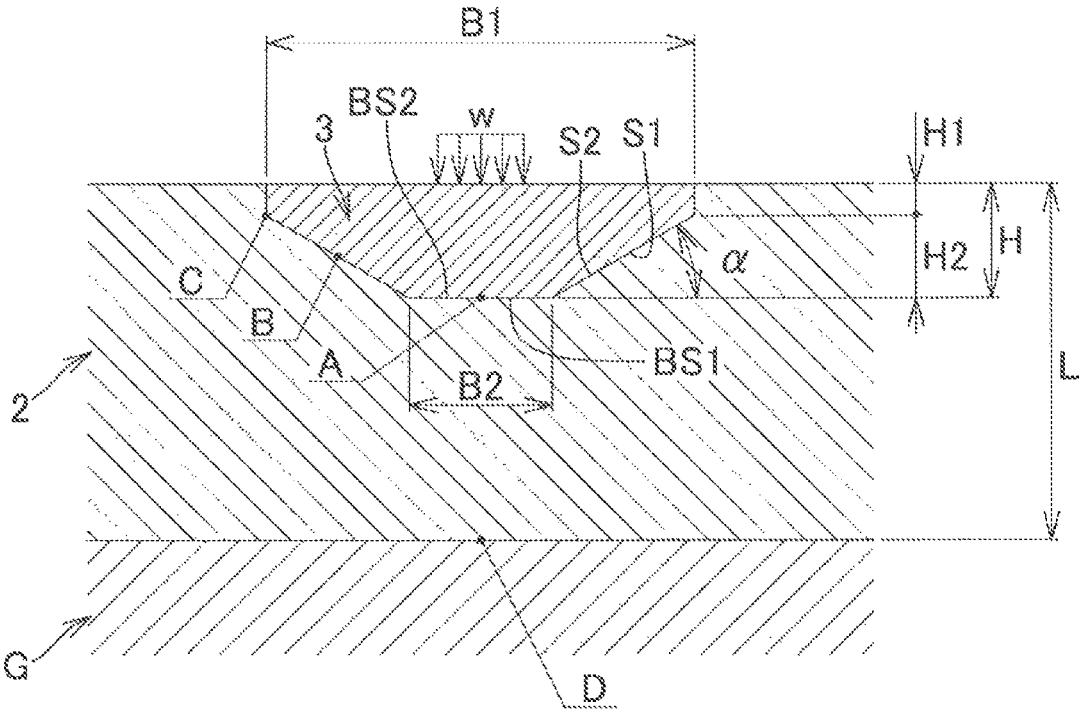

Numerical analysis is performed on an analysis model shown in the plan view in FIG. 4A and the sectional view in FIG. 4B, using ground finite element method (FEM) analysis software.

Setting is made as follows: improvement width L=2.5 m, foundation height H=0.8 m, and foundation transverse width B1=foundation longitudinal width W1=3.0 m.

A load applied to the foundation 3 is set to 900 kN, and a distributed load w of 2,500 kN/m$^2$ is applied to an area with a transverse-direction range a and a longitudinal-direction range b (a=b=0.6 m).

Evaluation items are principal stresses (kN/m$^2$) at points A to C underneath the foundation concrete 3, a ground contact pressure (kN/m$^2$) at a point D underneath the ground improved body 2, and a concrete amount (m$^3$) which is the volume of the foundation concrete 3, as shown in FIG. 4B).

(Examples and Comparative Example)

Analysis is performed while a slope angle α of the slope surfaces S1, S2 (side surface of reverse truncated cone) from a horizontal plane is changed as α=0°, 10°, 20°, 30°, 40°, 45°. The case of α=0° is defined as Comparative example, and the cases of α=10°, 20°, 30°, 40°, 45° are defined as Examples 1 to 5, respectively.

Figure 5A:
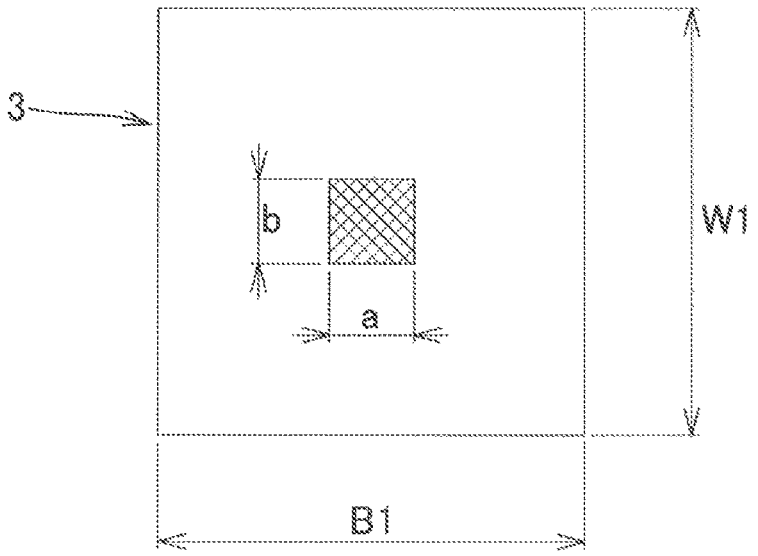
FIG. 5A is a plan view and FIG. 5B is a sectional view.
Figure 5B:
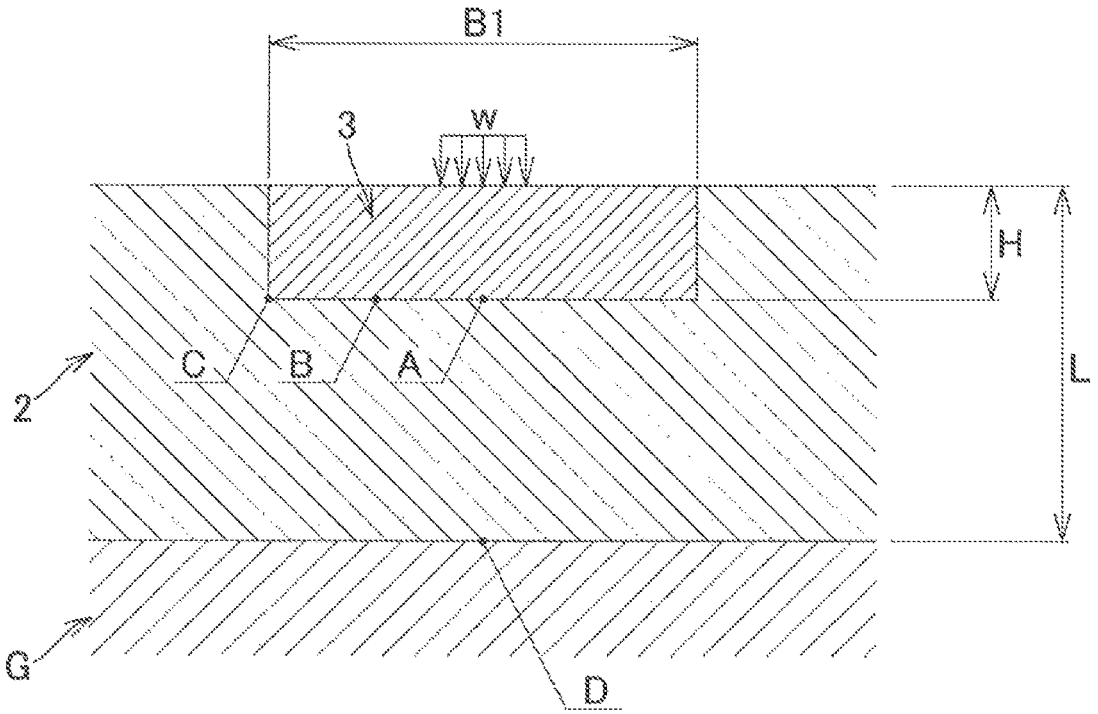

An analysis model in the case of α=0° in Comparative example has a shape shown in a plan view in FIG. 5A and a sectional view in FIG. 5B.

(Parameters)

With respect to α=10°, 20°, 30°, 40°, 45°, the transverse width B2 of the foundation bottom surface, the longitudinal width W2 of the foundation bottom surface, the height H1 of the rectangular parallelepiped part, and the height H2 of the reverse quadrangular frustum part are set as shown in Table 1.

(Analysis Result)

Table 1 shows a result of analysis for the evaluation items.

Figure 6:
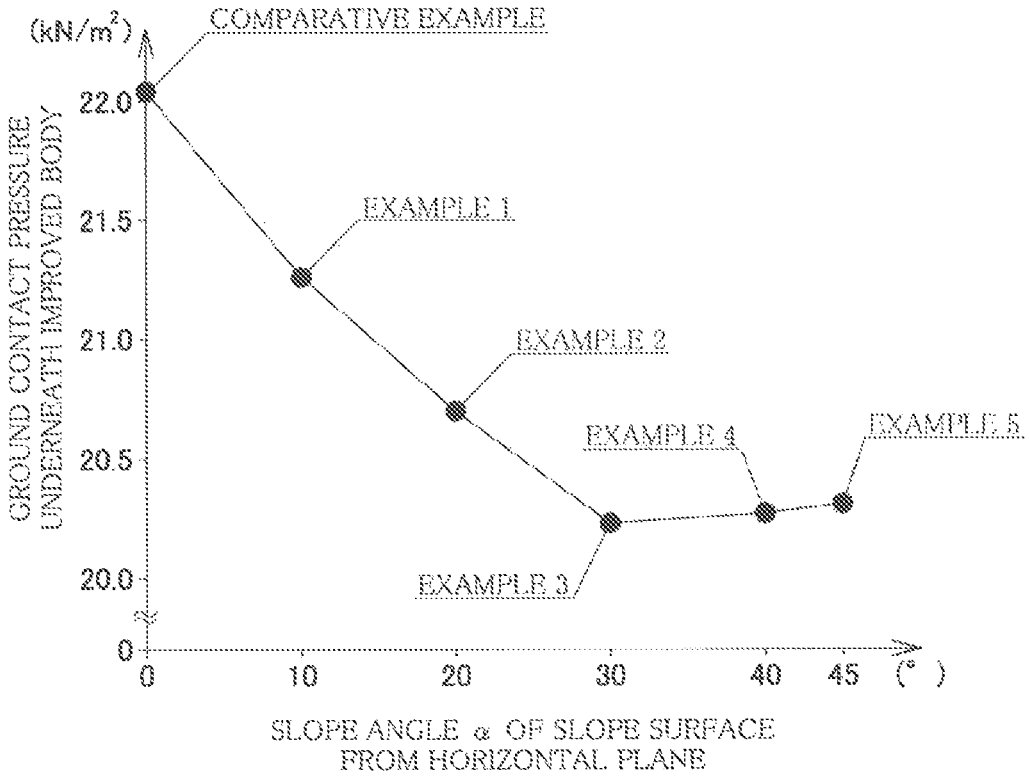
FIG. 6 is a graph showing change in a ground contact pressure underneath (at point D) the improved body with the slope angle α.
Figure 7:
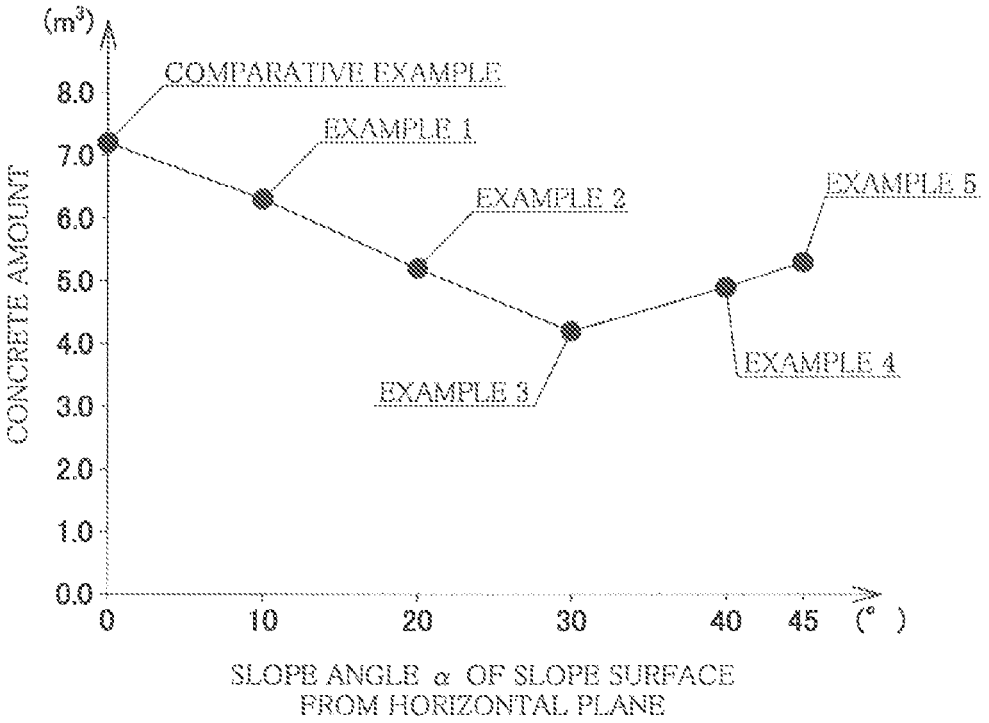
FIG. 7 is a graph showing change in a concrete amount with the slope angle α.

FIG. 6 shows change in the ground contact pressure ("Ground contact pressure underneath improved body") at the point D underneath the ground improved body 2 with respect to the slope angle α of the slope surfaces S1, S2 (side surface of reverse truncated cone) from the horizontal plane, and FIG. 7 shows change in the volume ("Concrete amount") of the foundation concrete 3 with respect to the slope angle.

TABLE 1

| Comparative example/ Example 1 | | Foundation concrete "Plan shape" (magnitude relation) "Bottom surface shape" | α (°) | L | H | B1 | W1 | B2 (m) | W2 | H1 | H2 | Principal stress underneath foundation concrete Point A | Point B | Point C (kN/m$^2$) | Ground contact pressure underneath improved body Point D | Concrete amount (m$^3$) |
|---|---|---|---|---|---|---|---|---|---|---|---|---|---|---|---|---|
| Comparative example | FIG. 5 | Square = Square | 0 | 2.5 | 0.8 | 3.0 | 3.0 | — | — | — | — | 42.00 | 60.00 | 541.0 | 22.04 | 7.2 |
| Example 1 | FIG. 4 | Square > Square | 10 | | | | | 1.0 | 1.0 | 0.62 | 0.18 | 43.40 | 64.00 | 510.0 | 21.26 | 6.3 |
| Example 2 | | | 20 | | | | | 1.0 | 1.0 | 0.4 | 0.4 | 51.00 | 65.39 | 491.6 | 20.70 | 5.2 |
| Example 3 | | | 30 | | | | | 1.0 | 1.0 | 0.2 | 0.6 | 53.09 | 75.04 | 479.9 | 20.23 | 4.2 |

TABLE 1-continued

| Comparative example/ Example 1 | Foundation concrete "Plan shape" (magnitude relation) "Bottom surface shape" | α (°) | L | H | B1 | W1 | B2 (m) | W2 | H1 | H2 | Principal stress underneath foundation concrete Point A | Point B | Point C (kN/m²) | Ground contact pressure underneath improved body Point D | Concrete amount (m³) |
|---|---|---|---|---|---|---|---|---|---|---|---|---|---|---|---|
| | | Parameter/evaluation item | | | | | | | | | | | | | |
| Example 4 | | 40 | | | | | 1.6 | 1.6 | 0.2 | 0.6 | 50.10 | 75.90 | 428.1 | 20.27 | 4.9 |
| Example 5 | | 45 | | | | | 1.8 | 1.8 | 0.2 | 0.6 | 46.00 | 75.50 | 449.0 | 20.31 | 5.3 |

From the graph in FIG. 6, it is found that the ground contact pressure underneath the improved body is smaller in Examples 1 to 5 having some slope angles α than in Comparative example having no slope angle α (α=0°).

The reason is considered as follows. In Examples, the shape of the lower surface of the foundation concrete 3 located below the building pillar 4 is a reverse quadrangular frustum. Therefore, the range in which stress is transferred from the foundation concrete 3 to the lower ground is broadened, and thus stress transferred to the lower ground can be reduced.

Then, it is found that the ground contact pressure underneath the improved body decreases as the slope angle α is increased, and the ground contact pressure underneath the improved body becomes further smaller in a range of 20°≤α≤40° and is minimized in the vicinity of α=30°.

For example, the ground contact pressure underneath the improved body in Example 3 (α=30°) is smaller by about 8% than the ground contact pressure underneath the improved body in Comparative example (α=0°).

In addition, from the graph in FIG. 7, it is found that the concrete amount is smaller in Examples 1 to 5 having some slope angles α than in Comparative example having no slope angle α (α=0°).

The reason is as follows. In Examples, the shape of the lower surface of the foundation concrete 3 located below the building pillar 4 is a reverse quadrangular frustum. Therefore, the volume of the foundation concrete is smaller in Examples (FIG. 4B) than in Comparative example (FIG. 5B).

Then, it is found that the concrete amount decreases as the slope angle α is increased, and the concrete amount becomes further smaller in a range of 20°≤α≤40° and is minimized in the vicinity of α=30°.

For example, the concrete amount in Example 3 (α=30°) is smaller by about 42% than the concrete amount in Comparative example (α=0°).

From the above analysis result, it is found that setting the slope angle α of the slope surfaces S1, S2 (side surface of reverse truncated cone) from the horizontal plane in a range not less than 20° and not greater than 40° is preferable because the reduction rate of the stress transferred to the lower ground and the reduction rate of the placing amount of the foundation concrete are increased, and in particular, setting the slope angle α to about 30° is more preferable because the reduction rate of the stress transferred to the lower ground and the reduction rate of the placing amount of the foundation concrete are maximized.

Hereinafter, regarding modifications of the plan shape of the foundation concrete 3 and the shape of the bottom surface BS1 of the foundation concrete 3, these shapes and ground FEM analysis results will be described.

Embodiment 2

Figure 8A:
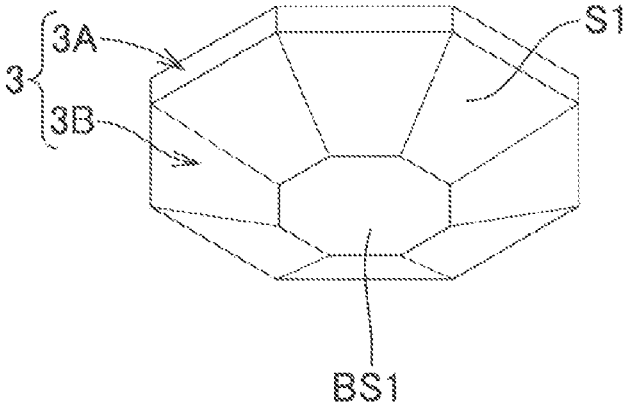
FIG. 8A is a perspective view as seen from below.
Figure 8B:
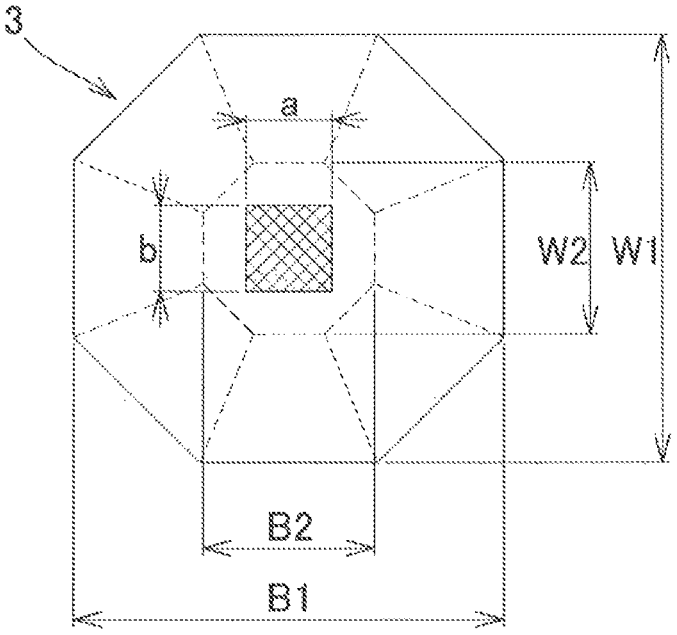
FIG. 8B is a plan view of a ground FEM analysis model similar to FIG. 4A and FIG. 4B.

Foundation concrete 3 in a building foundation structure according to embodiment 2 of the present invention is shown in a perspective view in FIG. 8A and a plan view of a ground FEM analysis model in FIG. 8B.

The plan shape of the foundation concrete 3 and the shape of the bottom surface BS1 are regular octagons.

The shape of the upper part 3A of the foundation concrete 3 is a regular octagonal prism, and the shape of the lower surface of the foundation concrete 3 corresponding to the lower part 3B of the foundation concrete 3 is a reverse octagonal frustum.

Embodiment 3

Figure 9A:
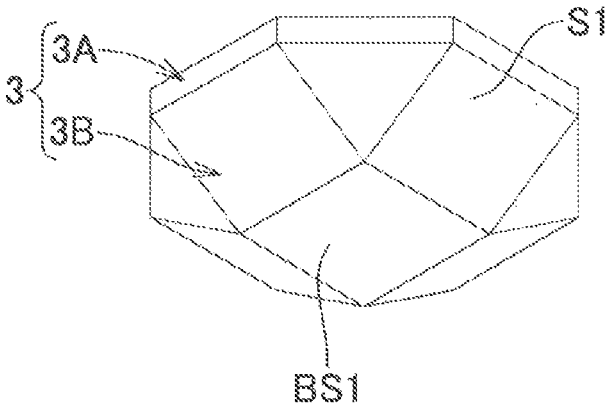
FIG. 9A is a perspective view as seen from below.
Figure 9B:
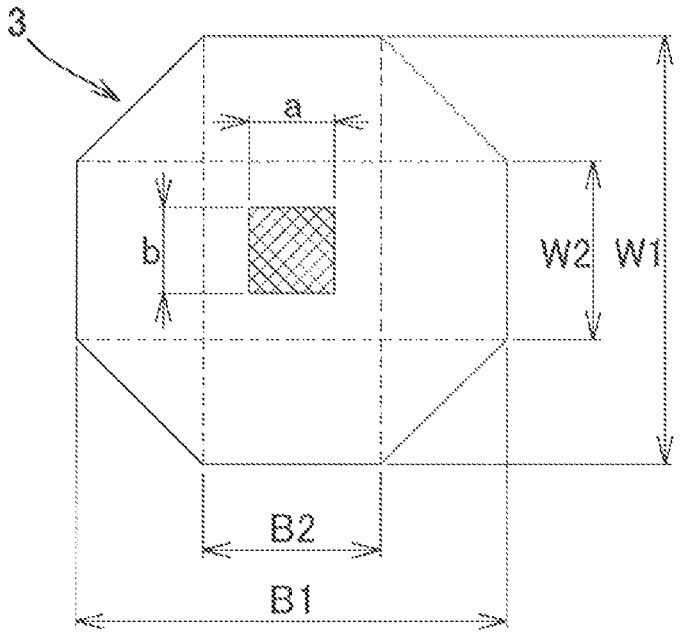
FIG. 9B is a plan view of a ground FEM analysis model similar to FIG. 4A and FIG. 4B.

Foundation concrete 3 in a building foundation structure according to embodiment 3 of the present invention is shown in a perspective view in FIG. 9A and a plan view of a ground FEM analysis model in FIG. 9B.

The plan shape of the foundation concrete 3 is a regular octagon, and the shape of the bottom surface BS1 is a square.

The shape of the upper part 3A of the foundation concrete 3 is a regular octagonal prism, and a part of the lower surface of the foundation concrete 3 other than the square-shaped bottom surface BS1 is formed to be slope surfaces connecting the lower end (regular-octagonal plan shape) of the upper part 3A of the foundation concrete 3 and the square-shaped bottom surface BS1.

Embodiment 4

Figure 10A:
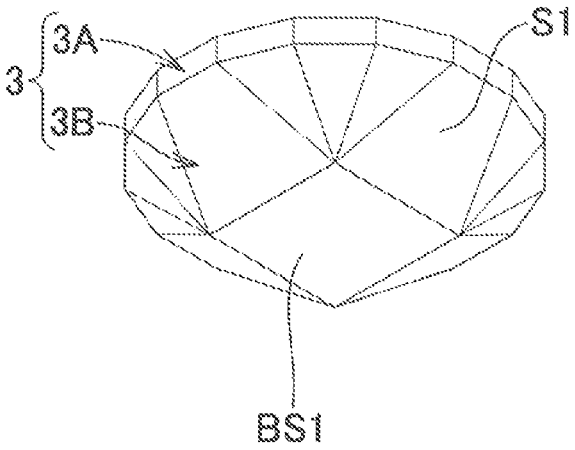
FIG. 10A is a perspective view as seen from below.
Figure 10B:
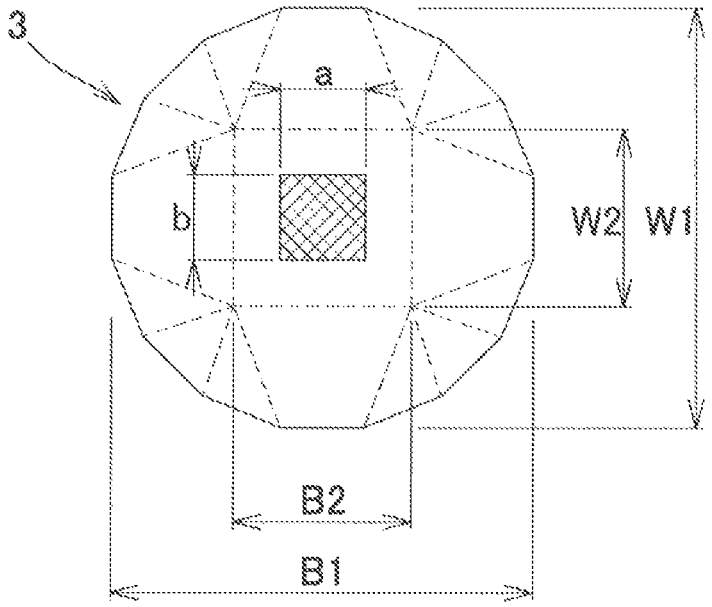
FIG. 10B is a plan view of a ground FEM analysis model similar to FIG. 4A and FIG. 4B.

Foundation concrete 3 in a building foundation structure according to embodiment 4 of the present invention is shown in a perspective view in FIG. 10A and a plan view of a ground FEM analysis model in FIG. 10B.

The plan shape of the foundation concrete 3 is a regular hexadecagon, and the shape of the bottom surface BS1 is a square.

The shape of the upper part 3A of the foundation concrete 3 is a regular hexadecagonal prism, and a part of the lower surface of the foundation concrete 3 other than the square-shaped bottom surface BS1 is formed to be slope surfaces connecting the lower end (regular-hexadecagonal plan shape) of the upper part 3A of the foundation concrete 3 and the square-shaped bottom surface BS1.

<Result of Ground FEM Analysis>

In embodiments 2 to 4, numerical analysis was performed using ground FEM analysis software, regarding analysis models similar to the analysis model shown in the plan view in FIG. 4A and the sectional view in FIG. 4B in embodiment 1.

Embodiments 2 to 4 are defined as Examples 6 to 8, and these Examples, in which the slope angle α of the slope surfaces S1, S2 from the horizontal surface is set as α=30°, are shown in Table 2, together with Comparative example and Example 3.

As in Table 1, evaluation items are principal stresses ($kN/m^2$) at the points A to C underneath the foundation concrete 3, a ground contact pressure ($kN/m^2$) at the point D underneath the ground improved body 2, and a concrete amount ($m^3$) which is the volume of the foundation concrete 3, as shown in FIG. 4B.

From Table 2, it is found that the ground contact pressures underneath the improved bodies in embodiments 2 to 4 (Examples 6 to 8) are smaller by about 6 to 7% than the ground contact pressure underneath the improved body in Comparative example (α=0°).

In addition, it is found that the concrete amounts in embodiments 2 to 4 (Examples 6 to 8) are smaller by about 36 to 39% than the concrete amount in Comparative example (α=) 0°.

As described above, the bottom surface BS1 of the foundation concrete 3 located below the building pillar 4 is formed in a four-or-more-sided polygonal shape smaller than the plan shape of the foundation concrete 3, and a part of the lower surface of the foundation concrete 3 other than the bottom surface BS1 is formed to be slope surfaces connecting the bottom surface BS1 of the foundation concrete 3 and the plan shape of the foundation concrete 3, whereby the stress from the foundation is transferred to the lower ground in its broader range, and thus stress transferred to the lower ground can be reduced.

In addition, since the foundation concrete 3 located below the building pillar 4 has the above shape, the volume thereof becomes smaller as compared to the shape of conventional foundation concrete 3 as shown in FIG. 5. Therefore, the placing amount of foundation concrete can be reduced, and thus construction cost can be reduced.

The description of the above embodiments is in all aspects illustrative and not restrictive. Various improvements and modifications can be made without departing from the scope of the present invention.

DESCRIPTION OF THE REFERENCE CHARACTERS

1 building foundation structure
2 ground improved body
2A upper excavated portion
2B lower excavated portion
3 foundation concrete
3A upper part
3B lower part
4 steel pillar
5 floor concrete
6 leveling concrete
B1 foundation transverse width
B2 transverse width of foundation bottom surface
BS1, BS2 bottom surface
G surface layer ground
GL ground level
H foundation height
H1 height of rectangular parallelepiped part
H2 height of reverse quadrangular frustum part
L improvement width
S1, S2 slope surface
W1 foundation longitudinal width
W2 longitudinal width of foundation bottom surface
a transverse-direction range in which equally distributed load acts
b longitudinal-direction range in which equally distributed load acts
α slope angle of slope surface from horizontal plane
w equally distributed load

TABLE 2

| Comparative example/ Example | | Parameter/evaluation item: Foundation concrete "Plan shape" (magnitude relation) "Bottom surface shape" | α (°) | L | H | B1 | W1 | B2 | W2 | H1 | H2 | Principal stress underneath foundation concrete: Point A | Point B | Point C ($kN/m^2$) | Ground contact pressure underneath improved body: Point D | Concrete amount ($m^3$) |
|---|---|---|---|---|---|---|---|---|---|---|---|---|---|---|---|---|
| | | | | | | | | (m) | | | | | | | | |
| Comparative example | FIG. 5 | Square = Square | 0 | 2.5 | 0.8 | 3.0 | 3.0 | — | — | — | — | 42.00 | 60.00 | 541.0 | 22.04 | 7.2 |
| Example 3 | FIG. 4 | Square > Square | 30 | | | | | 1.0 | 1.0 | 0.2 | 0.6 | 53.09 | 75.04 | 479.9 | 20.23 | 4.2 |
| Example 6 | FIG. 8 | Regular octagon > Regular octagon | | | | 3.4 | 3.4 | 1.1 | 1.1 | | | 52.99 | 74.34 | 303.4 | 20.67 | 4.4 |
| Example 7 | FIG. 9 | Regular octagon > Square | | | | | | | | | | 53.08 | 70.15 | 337.5 | 20.53 | 4.6 |
| Example 8 | FIG. 10 | Regular hexadecagon > Square | | | | | | | | | | 53.91 | 70.72 | 328.0 | 20.68 | 4.4 |

The invention claimed is:

1. A construction method for a building foundation structure that includes a ground improved body obtained by improving a surface layer ground, and foundation concrete placed on the ground improved body, the construction method comprising:

a ground improvement step;

a foundation excavation step; and a foundation placing step, wherein the ground improvement step is a step of backfilling soil obtained by digging a surface layer ground down, mixing and stirring the soil while adding and mixing a solidification material, and then performing compaction to form an improved ground, the foundation excavation step includes a step of excavating an upper part of the improved ground located below an above-ground part of a building pillar, into a polygonal prism shape with a plan outer perimeter defining a four-or-more-sided shape, to form an upper excavated portion, and a step of excavating a part below the upper excavated portion, forming a lower surface including a lower-most surface having a continuous outer perimeter, the lower-most surface defining a four-or-more-sided polygonal shape smaller than the plan outer perimeter of the upper excavated portion, and forming a sloped surface connecting the outer perimeter of the lower-most surface and a lower end of the plan outer perimeter of the upper excavated portion, thus forming a lower excavated portion, a slope angle of the sloped surface from a horizontal plane being not less than 20° and not greater than 40°, and the foundation placing step is a step of placing leveling concrete into the lower excavated portion, performing foundation reinforcing bar arrangement in the upper excavated portion and the lower excavated portion, and placing the foundation concrete.

2. The construction method of claim 1, wherein the sloped sides connect each of the four-or-more sides of the outer perimeter of the lower-most surface with the plan outer perimeter of the foundation concrete.

* * * * *